United States Patent [19]

Boeder et al.

[11] Patent Number: 4,558,645

[45] Date of Patent: Dec. 17, 1985

[54] WARHEAD

[75] Inventors: Dieter Boeder, Duesseldorf; Werner Grosswendt, Ratingen, both of Fed. Rep. of Germany

[73] Assignee: Rheinmetall GmbH, Duesseldorf, Fed. Rep. of Germany

[21] Appl. No.: 565,736

[22] Filed: Dec. 17, 1983

[30] Foreign Application Priority Data

Jan. 21, 1983 [DE] Fed. Rep. of Germany ..... 3301873

[51] Int. Cl.[4] ..... F42B 13/50

[52] U.S. Cl. ..... 102/489; 102/393; 102/505

[58] Field of Search ..... 102/340, 342, 351, 357, 102/489, 393, 505

[56] References Cited

U.S. PATENT DOCUMENTS 3,726,223 4/1973 Moe ..... 102/49
3,865,034 2/1975 Boulter ..... 102/393

FOREIGN PATENT DOCUMENTS 2920347 11/1980 Fed. Rep. of Germany ..... 102/489
3026159 8/1982 Fed. Rep. of Germany ..... 102/489

*Primary Examiner*—Harold J. Tudor

[57] ABSTRACT

An improved warhead for transporting a plurality of useful loads which are disposed in a useful load chamber of the warhead. The warhead includes a casing in which a star-shaped hollow body is disposed. The hollow body acts as a brace for the structural assembly and has a central axial pressurized gas passage. The hollow body divides the useful load chamber into a plurality of cells in each one of which a useful load is mounted. Each cell also has an inflatable bag which is disposed radially inwardly relative to the useful load. Each inflatable bag is in fluid communication with the central axial pressurized gas passage and is adapted to expel the useful load transversely with respect to the direction of flight of the warhead upon receiving an internal or external command. Each leg of the star-shaped hollow body has longitudinally extending grooves in which a detonating charge is disposed for severing the casing. A bottom and top plate are mounted at opposite ends of the casing and are biased against the hollow body and casing by means of at least one pretensionable shaft extending therethrough.

20 Claims, 3 Drawing Figures

WARHEAD

BACKGROUND OF THE INVENTION

A warhead having a useful load which is expelled from the warhead in a direction transverse to the flight path from individual chamber disposed in the warhead is known and is described in U.S. Pat. No. 3,726,223.

In this known warhead construction, forming part of the state of the art, there is disposed in a central region of the useful load space a hollow central column 34 which is closed at both at its axial ends by means of threaded nuts 36 and 38 on which end plates 30 and 32 are mounted. The end plates are mutually reinforced by reinforcing rods 18, 20, whereby the reinforcing rods are uniformly disposed one behind the other in the radial direction as well as in the peripheral direction parallel to the longitudinal axis of the warhead. There is wound a sheet metal star-shaped separating wall 16 (spacer diaphragm member) about the reinforcing rods, 18, 20, whereby this diaphragm defines within the missile casing 14 a plurality of uniform individual chambers, in which a plural arrangement of submunitions is disposed. The separating wall (diaphragm) 16 abuts in the innermost radial extent tangentially against the cylindrical sheath 50 in which a pipe 34 is coaxially disposed, which pipe contains a propellant charge. The missile casing 14 is severed by severing charges 42 which are secured against the inner side of the missile casing 14 centrally with respect to each individual chamber and parallel to the axis of the warhead. The submunition is expelled radially outwardly under the pressure produced by the ignited propellant charge through the gap formed by the severed missile casing 14 as a result of the outwardly bulging diaphragm 16 in a direction transversely to the flight direction from the individual chambers. This arrangement has the drawback that, as a result of the rotation of the warhead, the rotating front end plate, due to its moment of inertia, has a relative rotation with respect to the tail end plate, which corresponds to the rotation angle of the central column 34. The reinforcing rods cannot change this condition because of their high degree of slenderization. As a result of this rotation loads are applied in the peripheral direction due to the moment of inertia of the submunition, whereby neither the separating wall nor the reinforcing rods are capable to absorb these loads and to transfer them without impairment. Consequently deformations of the submunition cannot be excluded, and specifically at the separation of the casing by the deformation of the supports as a result of the action of the cutting charges 42 makes it impossible to avoid the damaging influence on the to be transported submunition forming the useful load. The reinforcing rods are not in a position to transfer loads in the direction of the warhead axis because, as a result of their high slenderness ratio, they only have a reduced buckling stability. As a result of these factors the useful load space of such a known warhead is not capable to meet the growing requirements of high flight precision as is the case with outwardly pivoting guide mechanisms which guide useful loads for maintaining precise guide functions.

SUMMARY OF THE INVENTION

It is an object of this invention to provide a warhead of the afore-described type which, in the region of the useful load space, maintains at starting and during flight a clearcut separation of the pressure-pull loads which make possible the application of torsion loads resulting from the useful load in the peripheral direction in various structural group. The useful load space of this novel warhead is of simple and compact construction, is easily assemblable, has a mechanism of reduced mass which distinguishes itself by a high degree of form stability while at the same time fulfilling a good expulsion function during the detachment process of the casing, so that during the expulsion of the useful load a high flight precision is achieved without hinderance by the casing.

The arrangement of the invention makes it possible that the useful load chamber of the warhead, which serves for transporting a plurality of useful loads, imparts the rotational movements to the useful loads which occur as a result of rotational acceleration during the starting process and at the flight of the warhead which loads are exclusively received by the outer casing and are transferred onto the warhead, whereas the mass-longitudinal forces of the useful loads which occur at the starting process and respectively at braking the warhead during the flight path and are absorbed by separate (with respect to the casing) bracing elements and are constructed as hollow bodies which are slidably displaceable in the warhead flight direction.

As a result of the hollow body being star-shaped and being movable via guides in a direction parallel to the axis of the warhead and being form-lockingly connected in the peripheral direction there is, on the one hand, achieved a uniform transfer in the longitudinal and peripheral direction of the load resulting from the torsion from the hollow bodies onto the casing and, on the other hand, due to the bracing of the hollow bodies a preponderantly rotation-secure casing. As a result of the closed outer casing of the casing and its reduced wall thickness there is achieved a particularly favorable relationship of the polar section modulus to the mass, a useful load space of high-form stability, whereby by means of this joining a negative effect due to torsion loading regarding a hinderance of the useful load is advantageously avoided.

The shape of the bracing elements which are formed as hollow bodies furnishes, as a result of their equal shanks-triangular shape for the to be readied useful load chambers, the advantages of, a high pressure receiving capacity by means of a reduced spatial requirement, an optimum use of the available space, a reduced mass and a high buckling stability.

The arrangement of preloaded bracing elements within the hollow body constitutes a particularly advantageous feature because it constitutes an optimum use of available space. The pretensional forces are absorbed in a secure and stable manner by the corresponding hollow bracing bodies, on the one hand, and provide a rational construction for a detachable connection, on the other hand, which are particularly useful with a simple assembly and a high tolerance manufacture because alignment of parts, which is conventionally required with non-detachable connections, is dispensed with.

The hollow bodies further distinguish themselves in that during the separation process of the casing as a result of the ignition of the detonating charge and the thereby occurring explosive shock, those parts of the hollow bodies which project in the radial direction and adjoin the detonating means, deform plastically as a result of the explosive effect of the detonating means, whereby a disadvantageous hinderance of the useful load is avoided.

The star-like connection of the hollow bodies permits, furthermore, for the purpose of expelling the corresponding useful load, to provide a direct conduit at the joints of two adjacent hollow bodies which are in communication with a central pressure gas conduit to provide pressurized fluid communication in a simple manner for inflating bags for the expelling process.

According to a further advantageous feature of the invention, the hollow bodies can be of unitary construction or can be joined in a mutually detachable manner by means of straps, whereby advantageously specific light cast parts made of an aluminum alloy can be used with only a minimal mechanical working.

In case the useful load space is provided with a plurality of useful loads which are not only arranged one next to the other but also one behind the other, the connected hollow bodies and straps can be mounted so as to be separate in an axial direction, whereby at the contact points of the hollow bodies intermediate separations are provided which can be connected by means of pretensionable screws in a space-saving manner.

The arrangement of the invention is particularly advantageously constructed in that the hollow profile of the assembly which confronts the casing performs a plurality of functions. This side of the hollow profile forms a form-locking joint in the peripheral direction with the casing, which is constructed to form a slidable guide in the axial direction and is additionally furnished in its interior with a groove which extends also axially-parallel for receiving a detonating charge for severing the casing, whereby next to the clear-cut separation of the to be transferred rotational moments from the axially directed push-forces, there is formed, on the one hand, by means of the shaping, separation and pretensioning of the hollow bodies a simply assemblable, yet compact in form stable useful load space, and, on the other hand, due to the shaping of the side of the casing which confronts the hollow profile there is prevented that after firing of the detonating means the explosive shock inhibits disadvantageously the useful load.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
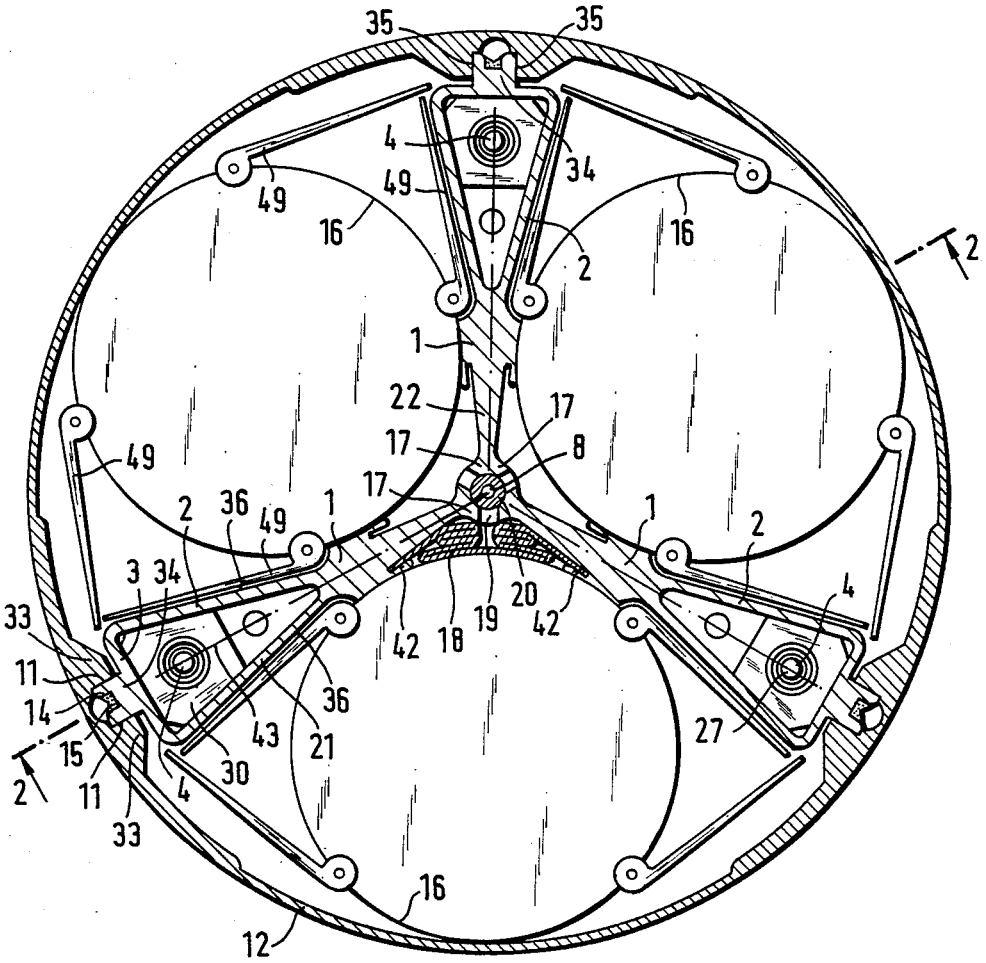
FIG. 1 is a transverse cross-sectional view of the warhead in the region of the useful load chamber along the plane 1—1 of FIG. 2 in which the hollow body is of unitary construction.
Figure 3:
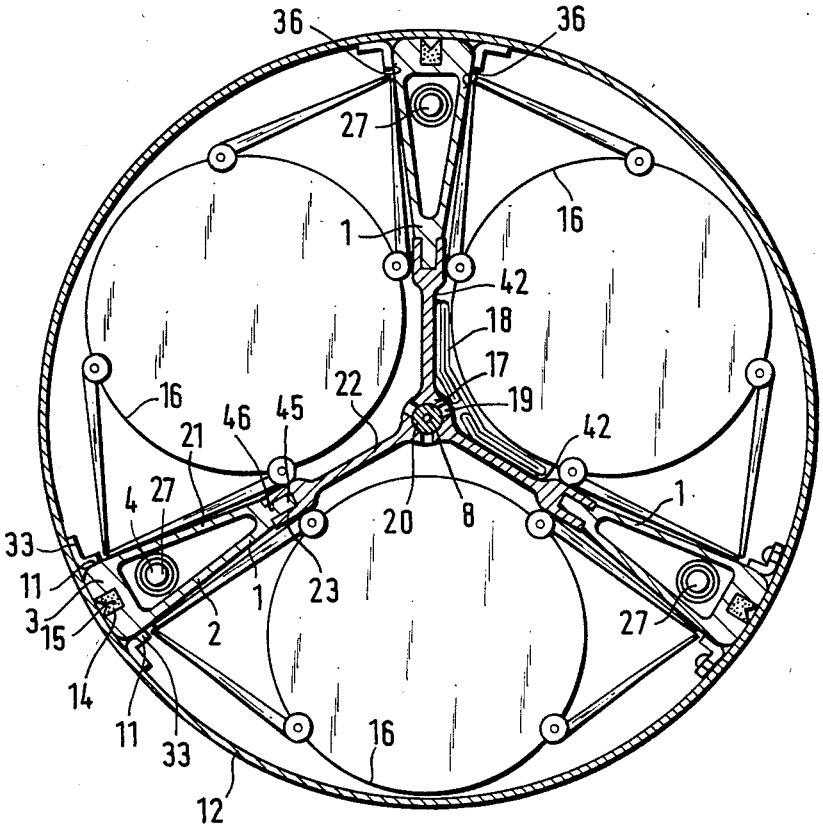
FIG. 3 is a cross-sectional view of the warhead along plane 1—1 of FIG. 2 of an alternate embodiment of the invention in which the useful load space is formed by mutually connected hollow bodies which are connected to each other in a mutually detachable manner.

Referring now to FIGS. 1 and 3 of the drawings there is illustrated a casing 12 which defines as a partial region of a warhead 13 a useful load chamber 5 disposed between a front end plate 6 and a rear end plate 7. The end plates 6 and 7 are joined by bracing members in the form of hollow bodies 2 (FIG. 3) or a hollow body (FIG. 1) which form(s) the bracing elements 1. These bracing elements 1 maintain by means of tensional connections 4 which coact with the casing 12, a plurality of useful loads 16 in a load-stable transport position. This arrangement also makes possible a flaw-free expulsion of the useful load 16 from the useful load chamber 5 at a predetermined point of the flight path in the direction normal to the warhead axis 8.

There are illustrated in FIG. 1 three bracing elements 1 which form a star-shaped mutually joined hollow body 2 having three branches each one of which has in profile a closed triangular shape. The junctions 17 of the three-legged hollow body 2 form a pressurized gas conduit 20 extending along the longitudinal central axis 8 of the warhead. The side surfaces 36 extend from the pressurized gas conduit 20 symmetrically relative to the middle axis 43 at each leg of the hollow body 2 from the gas conduit 20 to a radially outermost wall 3 at each leg. The wall 3 is normal to the middle axis 43 at each one of the legs of the hollow body 2 and is equidistant with respect to the longitudinal central axis 8. This wall 3 forms with the two side walls 36 a closed triangular profile 21. The side walls 36 have inner wall surfaces which are parallel to the outer wall surfaces of the side walls 36. The region of each leg of the hollow body 2 which is disposed between junction 17 and the closed triangular profile 21 is formed as a inwardly tapered web portion 22. A necked-down bolt 27 serves as the tensioning means 4 which bolt is disposed equidistantly from the side walls 36 and the outer wall 3 within the triangular closed profile 21, whereby also within each triangular closed profile 21 there is disposed a centering piece 30 which aligns not only the hollow body 2 relative to the end plates 6 and 7 (FIG. 2) but also effects by means of a pretensioning of a bolt 27 a form-stable connection between the end plates 6 and 7 (FIG. 2) and the hollow body 2. Each one of the outer walls 3 of the hollow body 2 contains an outwardly extending projection 34 which projects along the middle of each wall 3 parallel to the longitudinal central axis 8 along the entire length of each wall 3. This outwardly extending projection 34 has a pair of parallel sides walls 35 which contact the side walls of a guide element 33 of the casing 12 which is of equal length than the projection 34. The inner walls of element 33, tightly abut against the walls 35 thereof so as to form a slidable guide 11, permitting a slidable longitudinal displacement therethrough but a form-locking connection of the hollow body 2 with respect to the casing 12 in the peripheral direction. The rotational motion about the longitudinal axis 8 which occurs at the start of the warhead 13, and which is maintained during flight by auxiliary drive means, respectively is reinforced by such means, causes in the region of the useful load chamber 5 (FIG. 2) torsion loads which are engendered by the useful load 16 in the peripheral direction. These torsion loads are absorbed separately, in accordance with the invention, into the guides 11 of the casing 12 which is preponderantly rotation-secure and then onto the rear end plate 7 (FIG. 2), whereby the casing 12 by virtue of the axial slidability of the projections 34 through the guide elements 33, now is only in the position to transfer the loads acting in the peripheral direction. The projection 34 is provided at its radial outermost side with a groove 14 which is arranged symmetrically relative to the middle axis 43, which serves for receiving a detonating charge 15 for severing the casing 12. The outer wall 3 of the hollow body 2 is furthermore shaped in such a way that under the effect of the explosion of the detonating charge 15 it can deform plastically and thereby the useful load 16 and the guide wings 49 are not disadvantageously hindered. The space-saving construction of the star-shaped bracing elements 1 permit an optimum useage of the useful load space 5 (FIG. 2), in which for example three guidable useful loads are disposed one next to the other which useful loads have in a peripheral region affixed thereon outwardly swingable wings 49 for transporting the useful loads. At the side walls 36 of two confronting legs of the hollow 2 there are provided at a minimum parallel distance therefrom two of the four guide wings 49, whereas the space between the casing 12 and the useful load suffices for the disposition of two outwardly disposed guide wings 49, whereby the fin-stabilization (guide) wings 49 after leaving the useful load chamber 5 (FIG. 2) need only to perform a shortened stroke for assuming the guide (fin-stabilization) position for guiding the useful load 16 and thereby perform already at an early stage a precise guide function for the useful load 16 which for example is formed as a submunition. There is provided a bag 18 between each useful load 16 and each junction 17 of two adjoining legs of the hollow body 2 which is expendable by pressurized gas. The bag 18 is mounted in recesses 42 formed by the inwardly tapered portions 22. Each bag 18 is in fluid communication via a passage 19, disposed between two adjoining junctions 17, with the centrally extending pressurized gas conduit 20. When the warhead is used in combat, the casing 12 is severed by means of the detonating charges 15 and by means of a non-illustrated pressurized gas source, disposed in the warhead 13 (FIG. 2) the bags 18 are filled with pressurized gas via the pressurized gas conduits 20 and 19, whereby there results an expulsion of the useful load 16 in the radial direction from the useful load chamber 5 (FIG. 2).

Figure 2:
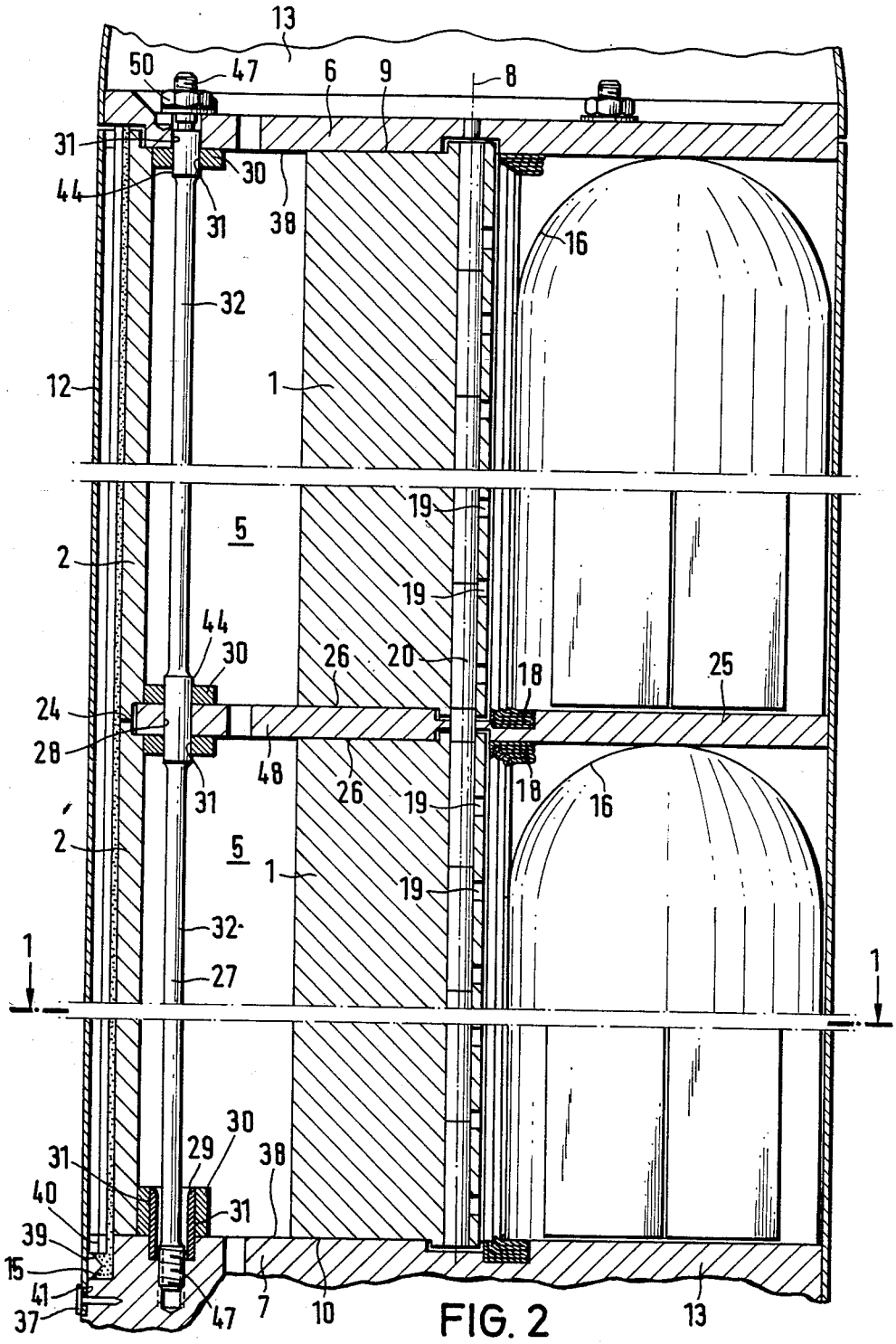
FIG. 2 is a partial cross-sectional elevational view of the warhead in the region of the useful load chamber along the plane 2—2 of FIG. 1.

As can be noted from FIG. 2 there are provided for limiting the useful load chamber 5 two end plates 6, 7 which extend transversely relative to the longitudinal central axis 8 of the warhead 13. The inwardly facing surfaces 38 of plates 6, 7 after the resulting pretensioning by means of the necked-down bolts 27, are pressed against the end faces 9 and 10 of the hollow body 2 formed as bracing elements 1 in a normal direction. The inertial forces of the useful load 16, which result from an acceleration respectively decelaration of the warhead 13, are either transferably directly onto the end plates 6, respectively 7, or are transferred by means of transferring means 25 onto the hollow body 2 and the web portions 22 for an immediate direct further transfer onto the end plate 6, respectively 7. These load transfer means 25 can advantageously be in the form of a disc-like intermediate plate 48, in which case the hollow body 2 and web portion 22 can be, for example divided into halves in the warhead flight direction. In this case the hollow body 2 can receive at their joint 24 the intermediate plate 48 and by means of the force exerted by the necked-down bolts 27 onto the surfaces 26 can also normally brace the there-against pressing intermediate plate 48. Both halves of the bracing elements 1 and the intermediate plate 48 are connected to each other by means of shaft portion 31 extending through bores 44 and forming part of the afore-mentioned necked-down bolts 27 which center these shaft portions 31, whereby the portions 31 are introduced into the bores of the centering members 30 and extend through the bores 28 of the intermediate plate 48 and are movable in an axial direction. The necked-down bolts 27 are provided at both ends 47 with an externally threaded portion, whereby advantageously for purposes of facilitating the assembly the bolts 27 can be screwed directly into the rear plate 7 and front plate 6 by means of threaded nuts 50 as a result of the fact that the threaded nuts 50 are arranged on the side of the plate 6 which is remote from the useful load chamber 5. The portion 44 of the necked-down bolt 27 is directly centered in the bore 31 of the end plate 6, whereby the front side of the hollow body 2 is fixable in the radial direction relative to the end plate 6, whereas at the side 38 of the rear bottom plate 7 the end of the hollow body abuts thereagainst and is fixable by means of a bushing 29 which can be matingly inserted into the bore 31 of the centering piece 30 and fixed in the plate 7, so as to be arrested in the radial direction. The casing 12 is only fixed in an axial parallel direction with respect to the axis 8 for avoiding tensions relative to the elastic buckling in the longitudinal direction of the warhead in the hollow body 2 at one side, whereby the rear end of the casing 12 is fixed on the annular surface 41 of the bottom plate 7 via means 37 which are either inserted or screwed in or impacted in a radial direction into the end plate 7. For purposes of the uniform load distribution through the casing 12 there are arranged not only the grooves 14 (FIG. 1) but also the grooves 40 which constitute a prolongation of the grooves 14 (FIG. 1) which latter grooves extend into the end plate 7 and merge in an annular groove 39. These grooves are filled with a detonating charge which can be ignited when the warhead is to be used in combat by means of an external or internal command. In order to furnish a flawfree expulsion of the useful loads disposed between the end plate 7 and the intermediate plate 48, on the one hand, and between the intermediate plate 48 and the end plate 6, on the other hand, there are provided in each partial cell of the useful load space 5 the inflatable bags 18 which expel the submunitions in an axial direction along the entire length of the warhead, bag 18 which bags are disposed between two junctions 17 (FIG. 1), whereby each bag 18 is directly in fluid communication via a plurality of conduits 19 with the pressurized gas conduit 20, whereby the bags 18 are uniformly filled with pressurized gas and thereby effect a quick expulsion of the useful load 16 in a direction normal to the longitudinal central axis 8. The hollow body 2, can in accordance with the embodiment of FIG. 1, be made of unitary construction, for example out of a cast aluminum alloy having a light specific weight. The triangular hollow profile 21 of the hollow body 2, in accordance with the embodiment of FIG. 3, consists of separate cast parts which are joined to each other by means of joints 23, which joints extend radially with respect to the central longitudinal axis 8 and form a star-shaped unit which has a central pressurized gas conduit 20 formed by three web portions 22. With minimum mechanical working the web portions 22 which are joined to the triangular shaped hollow profiles 21 can also be made out of a light aluminum cast alloy having a light specific weight. The joints 23 provide a good connection of each separate leg of the hollow body 2 by means of a detent connection which is formed in a gap 46 defined by two fork legs 23 of the web 22. Thus, the hollow profile 21 has a radially inwardly extending portion 45 which extends into the gap 46 thereby forming a separable detent connection.

In the embodiment of FIG. 3 the guides 11 are formed by means of a pair of angles 33 which have inwardly facing walls that abut against the side surfaces 36 of the hollow profile 21 and these angles 33 form a guide groove through which the hollow body 2 can relatively move in an axial-parallel direction. The angles 33 are fixed on the inner wall of the casing 12. There extend through each one of the hollow profiles 21, in manner analogous to the embodiment of FIG. 1, pretensioning means 4 for providing a tensional connection via a necked-down bolt 27. The outer wall 3 is formed in such a way that is has in its middle portion a radially inwardly extending groove 14 for receiving the necessary detonating charge 15 for severing the casing 12, whereby the bottom of the groove 14 is plastically deformable under the action of the explosion and thereby prevents a disadvantageous influence on the useful load 16.

In order to assure also a flawfree expulsion of the useful load 16 in the direction normal to the longitudinal central axis 8 there is provided in the space between each junction 17 and each useful load 16 and extending up to detent connections of two adjoining webs 22 a bag 18 which can be inflated by pressurized gas being conducted through the pressurized gas conduit 20 and the directly joined conduits 19.

When the useful loads 16 are not directly fixed by form-locking with the casing 12, the bracing elements 1, the bottom plates 6, 7 (FIG. 2) and the intermediate bottom 48 (FIG. 2) in their transport position, they can also be fixed by means of separate non-illustrated connecting elements onto the bracing elements 1 during flight, which at expulsion of the useful load 16 by means of the pressure of the blown-up bags 18, lose there holding function.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. An improved warhead for transporting a plurality of useful loads in a useful load chamber which is disposed inside an outer casing and which is divided into a plurality of cells by a hollow body and includes means for expelling the useful loads from the warhead in a direction transverse to the longitudinal axis of the warhead, the improvement comprising in combination, (a) the hollow body is star-shaped and forms at least three mutually joined bracing elements formed by three leg portions of the hollow body which extend in a longitudinal direction parallel to the longitudinal axis of the casing and also extend radially outwardly therefrom;

(b) an upper end plate and a lower end plate abut against the axial opposite ends of the casing and the hollow body, and pretensionable connecting means biasing the upper and lower end plates towards each other so as to press them against the axial upper and lower ends of the casing and hollow body;

(c) the inner wall of said casing and said hollow body having a plurality of longitudinally extending connecting means so as to prevent a relative movement between said hollow body and said casing in the peripheral direction but permit a longitudinal slidable relative movement in the axial direction of the casing and hollow body, whereby said casing preponderantly transfers in the region of the useful load chamber torsional loads whereas the acceleration, respectively decelaration forces formed by inertial forces of the useful loads are separately preponderantly transferred by the hollow body;

(d) each leg portion of the hollow body has an outer radial wall portion on the outer wall of which a longitudinally extending first groove is disposed for holding a detonating charge therein for severing said casing upon ignition of the detonating charge; and (e) an inflatable bag is disposed between each pair of said adjoining leg portions of said hollow body, said hollow body defining a central axial pressurized gas passage and a plurality of radial pressurized gas passages which are in fluid communication with each inflatable bag.

2. The improvement in a warhead for transporting a plurality of useful loads as set forth in claim 1, wherein each leg portion of said hollow body has a closed triangular cross-sectional shape in a radial plane.

3. The improvement in a warhead for transporting a plurality of useful loads as set forth in claim 2, wherein said hollow body defining said leg portions and central axial pressurized gas passage is of unitary and integral construction.

4. The improvement in a warhead for transporting a plurality of useful loads as set forth in claim 2, wherein said hollow body has a central portion which defines said central axial pressurized gas passage, at least three integral web portions are equidistantly spaced from each other around the central portion and extend radially outwardly from said central portion, and a closed triangular cross-sectional shape in a radial plane portion of the hollow body is detachably connected to each web portion.

5. The improvement in a warhead for transporting a plurality of useful loads as set forth in claim 4, wherein the connection between each web portion and closed triangular cross-sectional shape in a radial plane portion is a detent connection.

6. The improvement in a warhead for transporting a plurality of useful loads as set forth in claim 5, wherein each web portion has a pair of parallel outwardly extending fork legs and each closed triangular cross-sectional shape in a radial plane portion has a radially inwardly extending leg which extends between the pair of fork legs and is frictionally engaged by them.

7. The improvement in a warhead for transporting a plurality of useful loads as set forth in claim 6, wherein said central portion has three integral web portions and three closed triangular cross-sectional shape inner radial plane portions which jointly form the hollow body and which can be jointly or separately inserted into the casing.

8. The improvement in a warhead for transporting a plurality of useful loads as set forth in claim 7, including load transfer means operatively connected to said hollow body for transferring acceleration or decelaration forces acting in the longitudinal direction of the hollow body onto the web portions of the hollow body, which load transfer means are arranged transversely with respect to the longitudinal axis of the casing.

9. The improvement in a warhead for transporting a plurality of useful loads as set forth in claim 8, in which said hollow body is divided into at least two portions in the longitudinal direction by means of said load transfer means, said load transfer means being in the form of an intermediate plate the outer periphery of which is in contact with an outer leg of the closed triangular cross-sectional shape in a radial plane portion.

10. The improvement in a warhead for transporting a plurality of useful loads as set forth in claim 9, wherein said pretensionable connecting means are formed by at least one shaft which is parallel to the central longitudinal axis of the casing and which extends through said hollow body and is threadably connected to the upper and lower end plates, which shaft has at least one guide portion.

11. The improvement in a warhead for transporting a plurality of useful loads as set forth in claim 10, wherein said intermediate plate is in the shape of a disc and includes a bore through which said guide portion of the shaft extends and matingly engages, whereby the intermediate plate is radially aligned with the top and bottom plates and the web portions of the hollow body are biased uniformly against opposite surfaces of the intermediate plate by means of the shaft forming the pretensionable connecting means.

12. The improvement in a warhead for transporting a plurality of useful loads as set forth in claim 11, including centering means disposed in the upper and lower end plates, said centering means including bores through which the shaft extends, the centering means on the bottom plates having a bushing adapted to be coaxially mounted therein for purposes of radially centering the upper and bottom plate relative to the shaft.

13. The improvement in a warhead for transporting a plurality of useful loads as set forth in claim 12, wherein the inner walls of said casing have a plurality of longitudinally extending second grooves and said hollow body having a corresponding plurality of longitudinally extending connecting means which are disposed in said longitudinally extending second grooves and slidably engage therein.

14. The improvement in a warhead for transporting a plurality of useful loads as set forth in claim 13, wherein said connecting means includes a radially outwardly extending projection which also extends longitudinally parallel to the central longitudinal axis of the casing which projection extends into said longitudinally extending second groove and is slidably disposed therein.

15. The improvement in a warhead for transporting a plurality of useful loads as set forth in claim 14, wherein the closed triangular cross-sectional shape in a radial plane portion of the hollow body extends into the longitudinal groove on the inner wall surface of the casing and slidably engages the wall surfaces of said groove.

16. The improvement in a warhead for transporting a plurality of useful loads as set forth in claim 15, wherein the outermost leg of the closed triangular cross-sectional space in the radial plane portion has said first longitudinally extending groove which is disposed in the second longitudinally extending groove.

17. The improvement in a warhead for transporting a plurality of useful loads as set forth in claim 16, wherein said bottom plate has a plurality of third grooves which constitutes extensions of said plurality of first grooves and detonating means being disposed in said plurality of first longitudinally extending and third grooves, said detonating means severing said casing upon ignition.

18. The improvement in a warhead for transporting a plurality of useful loads as set forth in claim 17, wherein said casing is fixed only unilaterally in the axial direction.

19. The improvement in a warhead for transporting a plurality of useful loads as set forth in claim 18, wherein the lower end of said casing is secured onto said bottom plate by radially inwardly acting connecting means.

20. The improvement in a warhead for transporting a plurality of useful loads as set forth in claim 19, wherein said inflatable bag is disposed in a recess defined by two adjoining web portions of said hollow body.

* * * * *